US005396666A

United States Patent [19]

Tsai et al.

[11] Patent Number: 5,396,666

[45] Date of Patent: Mar. 14, 1995

[54] FLUSH DEVICE FOR TOILET

[76] Inventors: Pang-Yen Tsai; Chien-Liang Hsiao, both of Suite 11F, No.95-8 Chang Ping Road. Sec. 1, Taichung, Taiwan, Taiwan, Prov. of China

[21] Appl. No.: 167,250

[22] Filed: Dec. 16, 1993

[51] Int. Cl.[6] ..... E03D 1/14

[52] U.S. Cl. ..... 4/325

[58] Field of Search ..... 4/324, 325, 378, 392, 4/393, 405, 411, 412, 413, 414, 415

[56] References Cited

U.S. PATENT DOCUMENTS 2,046,888 7/1936 Watt ..... 4/412

2,412,738 12/1946 Martin ..... 4/412

4,080,668 3/1978 Banes ..... 4/325

*Primary Examiner*—Charles E. Phillips

[57] ABSTRACT

A flush device for toilet comprises within a water tank a support arm, a restricting member and a outlet valve thereof attached in series to an overflow tube, and an actuating assembly including a actuator arm thereof connected with the outlet valve via the support arm by a lift wire or chain thereinbetween. This disclosure has been characterized in a pulley on the top of the support arm, a displaceable and inversible restricting member and a flexible actuating assembly which facilitate a varying the discharge amount of the flush water and a smooth operation in different moods.

5 Claims, 10 Drawing Sheets

FLUSH DEVICE FOR TOILET

BACKGROUND OF THE INVENTION

The present invention relates to water closet, more particularly to a flush device for toilet, which device is adjustable for variating the discharge amount of the flush water into a toilet pan.

Prior art toilet generally comprises a water tank having a water inlet device and a flush device therein. The water inlet device is similarly composed of a tube and a ball-cock assembly on the top thereof connecting a float arm with a float ball thereon. When the pouring in water reaches to a certain lever in the water tank, the float ball then actuates the ball-cock via the float arm so as to stop the water from continuously pouring in; The flush device may vary in shape but generally has a valve seat, a tank ball pivotally connected to an overflow tube and suspended from a lever means via a lift wire, and a flush handle connected with the lever means thereof actuates the tank ball upward for discharging the flush water into a toilet pan.

Their common disadvantages are characterized in lacking of structural flexibility for adjusting the discharge amount of the flush water therein so that every time when the flush device is actuated, a tankful of water is discharged totally regardless whether such large amount of water is needed. Since, in many occasions such as to flush urine or a small amount of excreta, a smaller amount of flush water is sufficient, it causes a waste of water source, which is uneconomical and detrimental to the environmental reguirement.

SUMMARY OF THE PRESENT INVENTION

The present invention has a main object to provide a flush device for toilet which is structurally improved to enable the discharge amount of flush water to be controllable.

Another object of the present invention is to provide a flush device for toilet, which is structurally displaceable to facilitate the flush handle thereof to be operated in an inverse direction in order to cope with the operational habit of the users.

Accordingly, the present invention of a flush device for toilet generally comprises an overflow tube coupled in sequence with a support arm, a restricting member and a outlet valve, a lift wire or chain connected on one end with the outlet valve and the other end with a actuating assembly in order to lift up the outlet valve for discharging a selective amount of flush water into the toilet pan from the water tank therein. The restricting member which has a pair of upward projected rods and a transverse spring thereof is provided to limit the span of the up and downward movement of the lever means and the outlet valve in varied levels. The restricting member can be affixed upside down to the overflow tube therefore altering an operational direction for the actuating assembly.

The present invention with be fully understood by reference to the following detailed description thereof when read in accompanying with the attached drawings.

DETAIL DESCRIPTION OF THE PREFERRED EMBODIMENT OF THE PRESENT INVENTION

Figure 1:
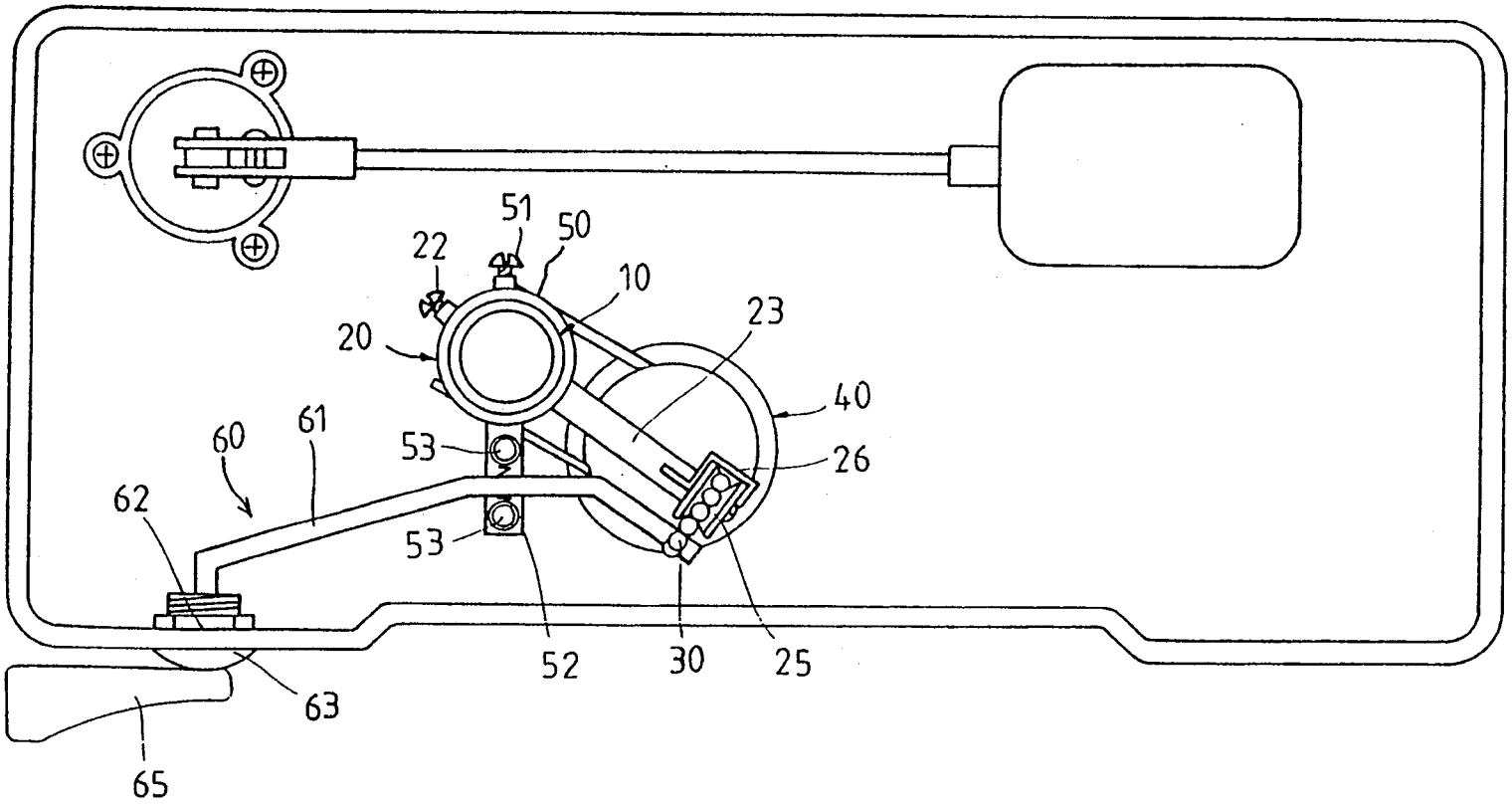
FIG. 1 is a top plane view to show a preferred embodiment of the present invention.
Figure 2:
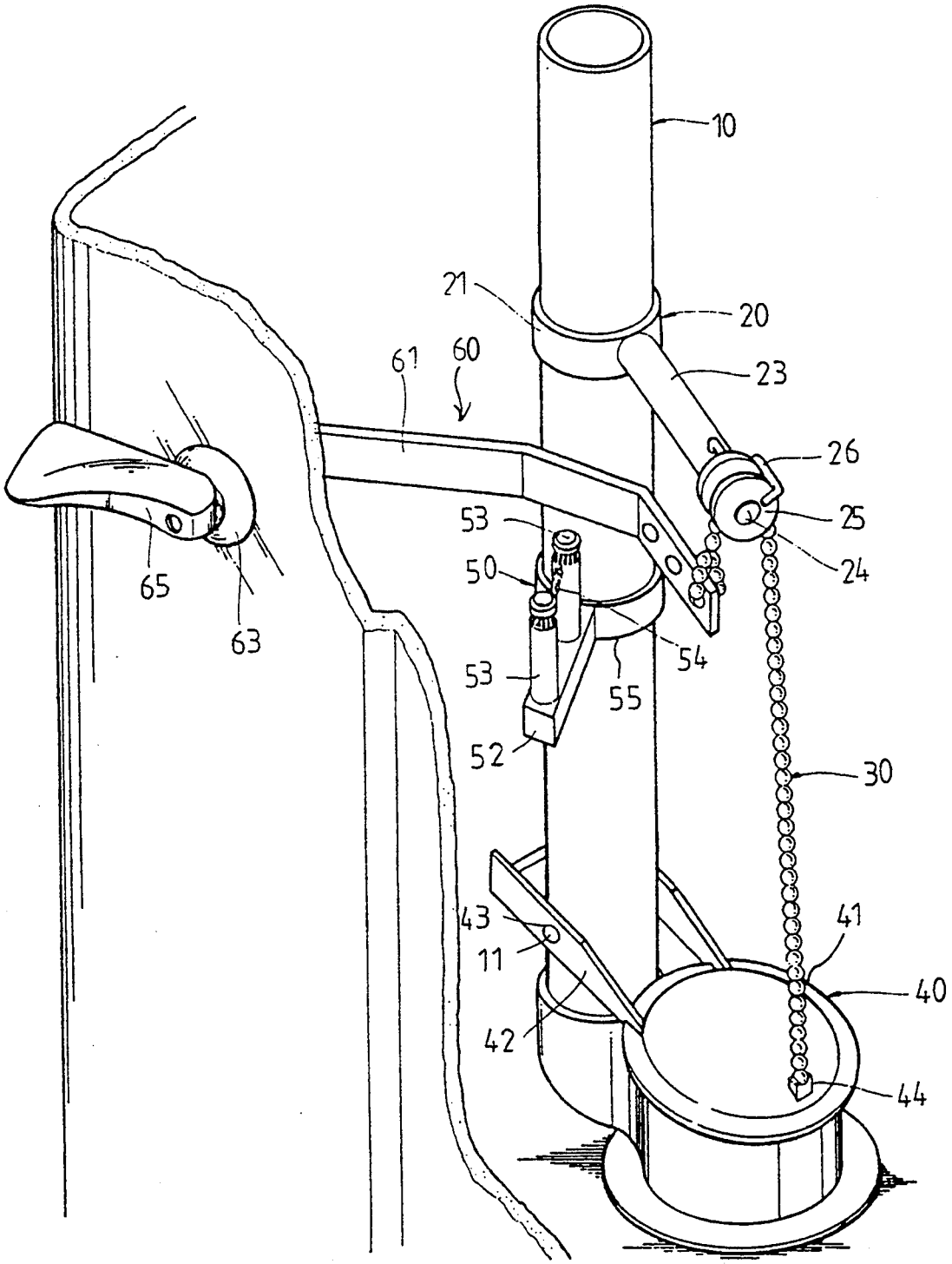
FIG. 2 is a perspective view to show a preferred embodiment of the present invention.

Please, with reference to FIGS. 1 and 2 of the drawings, the present invention of a flush device for toilet comprises generally an overflow tube 10, a support arm 20, a lift wire or chain 30, a outlet valve 40, a restricting member 50 and an actuating assembly 60 disposed to a water tank therein.

Figure 8:
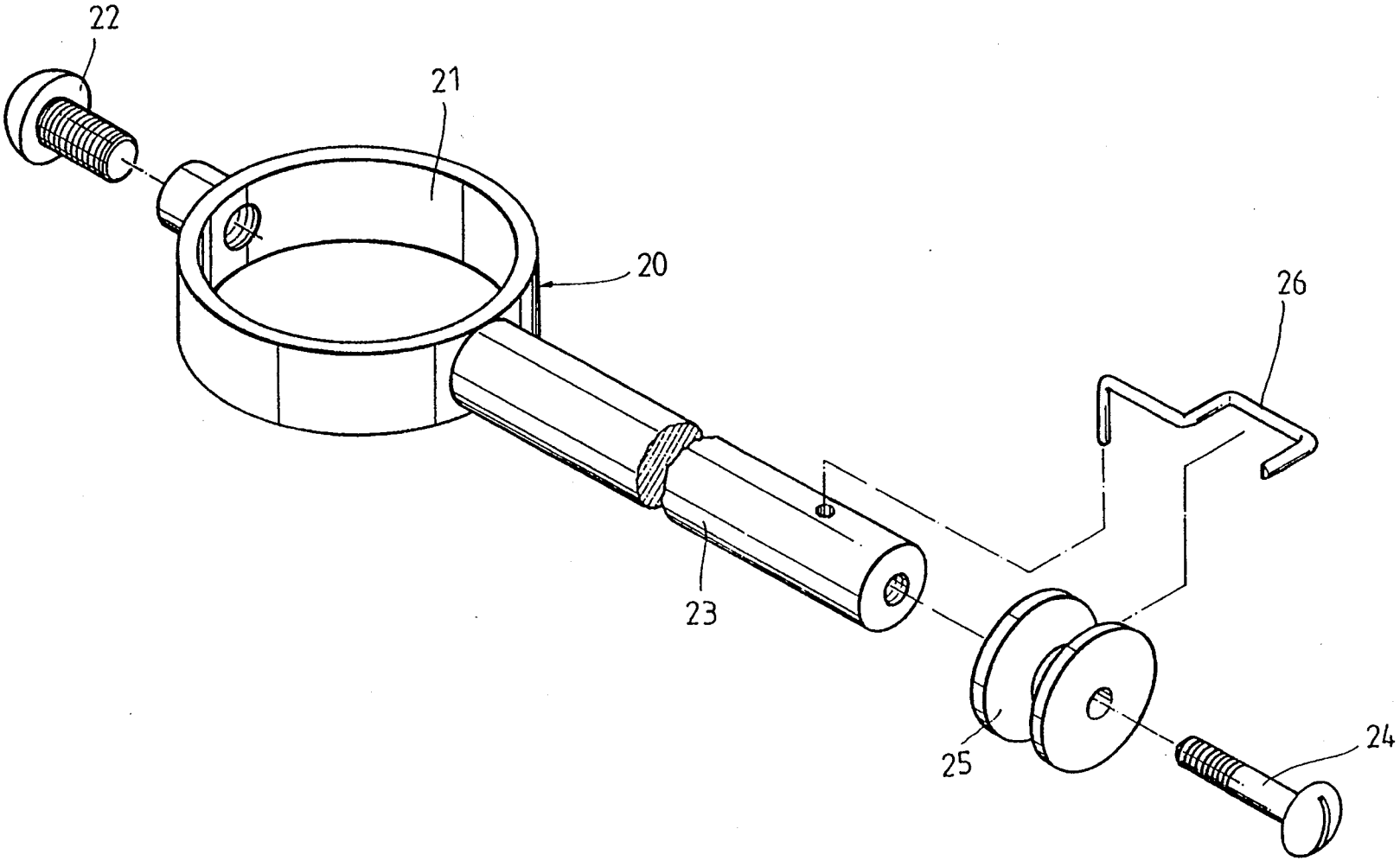
FIG. 8 is an exploded perspective view to show in detail of a support arm of the present invention.

The support arm 20 comprises a cylindrical body 23 having on one end connected with a retaining ring 21 and other end with a pulley 25 which is perpendicularly secured in rotation by a slotted screw 24 and abutted upon a catch pawl 26 which is affixed to a peripheral hole of the cylindrical body 23 (See FIG. 8). The support arm 20 is telescoped to the upper portion of the overflow tube and secured by a screw 22 thereon with the pulleyed end keeping in alignment with the walve seat of the tank.

The outlet valve 40 comprises a flying-disk shaped body of hallow interior having a circular flange 41 and a clevis 42 extended from a peripheral end thereof which has a pair of axle apertures 43 on opposing medial portion for pivoting to the outer periphery at the lower partion of the overflow tube 10 thereon by an axle pin 11, the free end of the clevis 42 is connected with a transverse rod thereinbetween. A hoop means 44 disposed to an opposing periphery thereon for connecting with the lift wire 30.

The lift wire or chain 30 which is suspended from the pulley connects on one end with the outlet valve 40 and other end with the actuating assembly 60.

The restricting member 50 comprises an elongate rectangular body 52 having a pair of spaced vertical rods 53 projected upward at upper surface therefrom and a recoil spring 54 connected on their upper ends thereinbetween. A retaining ring 55 connected to one end of the elongate body 52 and secured by a screw 51 to the medial portion of the overflow tube 10, with the elongate body thereof 52 directs to the front side of the water tank.

Figure 9:
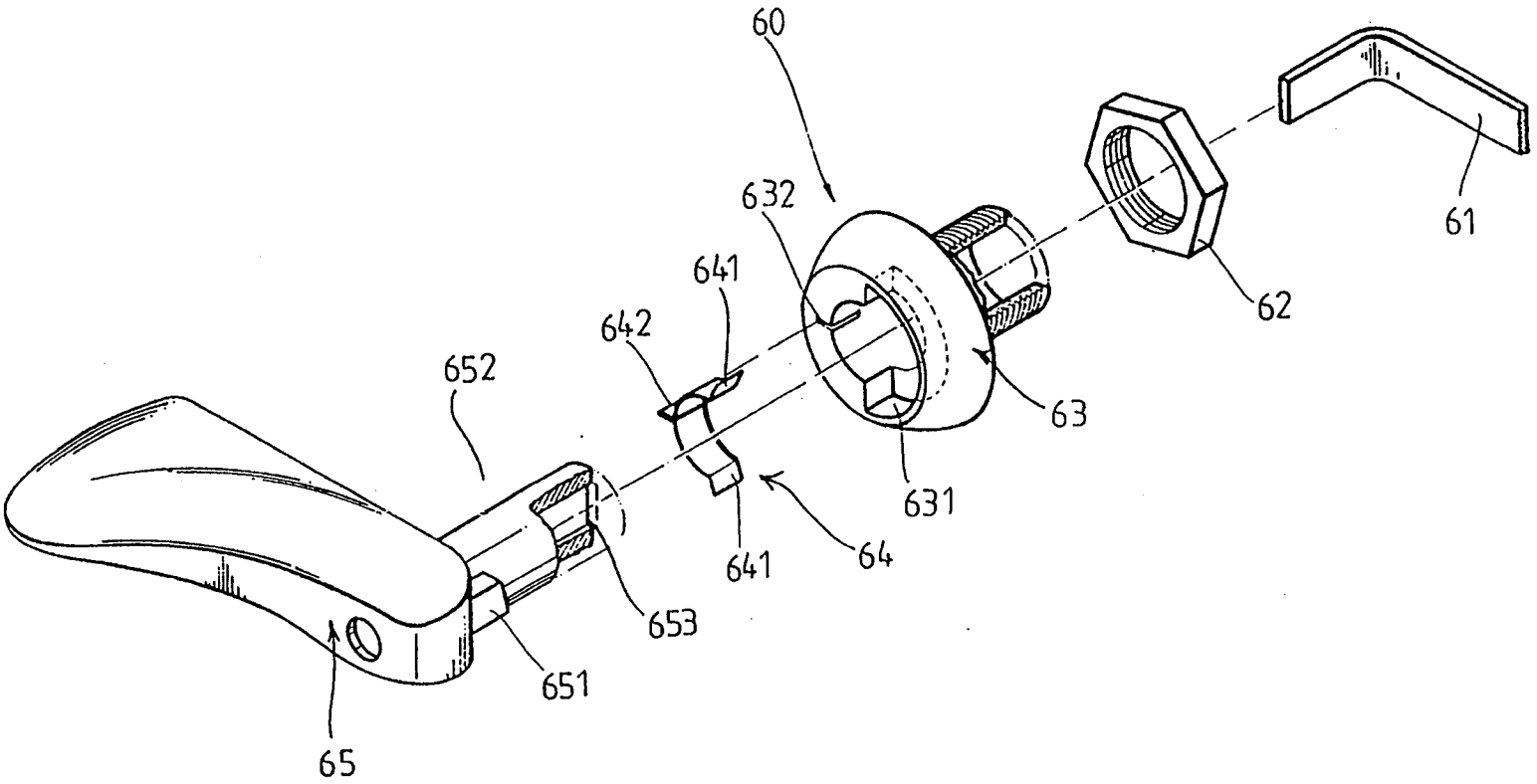
FIG. 9 is an exploded perspective view to show in detail of a actuating assembly of the present invention.
Figure 10:
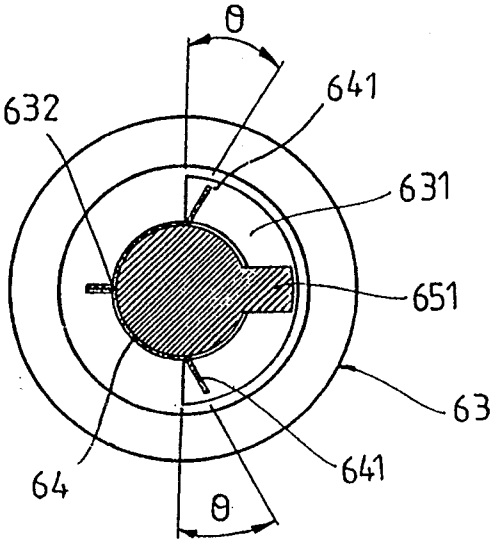
FIG. 10 is a sectional view of FIG. 9.

Referring to FIGS. 9 and 10, the actuating assembly 60 comprises an actuator arm 61, a hexagonal bolt 62, a jacker means 63, a spring detent 64 and a strip handle 65 thereof.

The actuator arm 61 has on one end a transverse portion and other end two bends and three circular holes spacedly formed thereof (see FIG. 2). The jacker means 63 has a centrally formed cylindrical recess, a larger diameter portion having a semi-circular groove 631 on front side, a notch 632 on the inner periphery thereof opposite to the groove 631 and a lesser diameter portion with threaded outer periphery projected outward on the rear side therefrom. The spring detent 64 has a semi-circular body including a laterally bent flap 641 on each end and a tab 642 on central back thereof. The strip handle 65 has a cylindrical portion 652 abutting on a rectangular protrudent member 651 perpendicularly extended at one end therefrom. The cylindrical portion 652 has a central slot 653 thereof for the securement of the transverse portion of the lever bar 61 therein.

When assembling, fasten firstly the jacker means 63 by the hexagonal bolt 62 onto a circular hole provided at a proper position of the water tank, then affix the spring detent 64 into the cylindrical recess of the jacker means 63 with the tab 642 thereof inserted into the notch 632 and the bent flaps 641 against the end walls of the groove 631, and then insert the strip handle 65 on it's cylindrical portion 652 into the cylindrical recess of the jacker means 63 with the rectangular protrudent stopper 651 engaged with the semi-circular groove 631 therein so that the strip handle 65 is retained by the spring detent 64 and restrictively rotated about the groove 631 therein (see FIG. 10), finally, secure the transverse portion of the actuator arm 61 to the central slot 653 of the strip handle 65 therein and the other end of the actuator arm 61 connects with one end of the lift wire 30 which is connects on other end with the tank ball and suspends from the pulley of the support arm 20 thereon.

Figure 3:
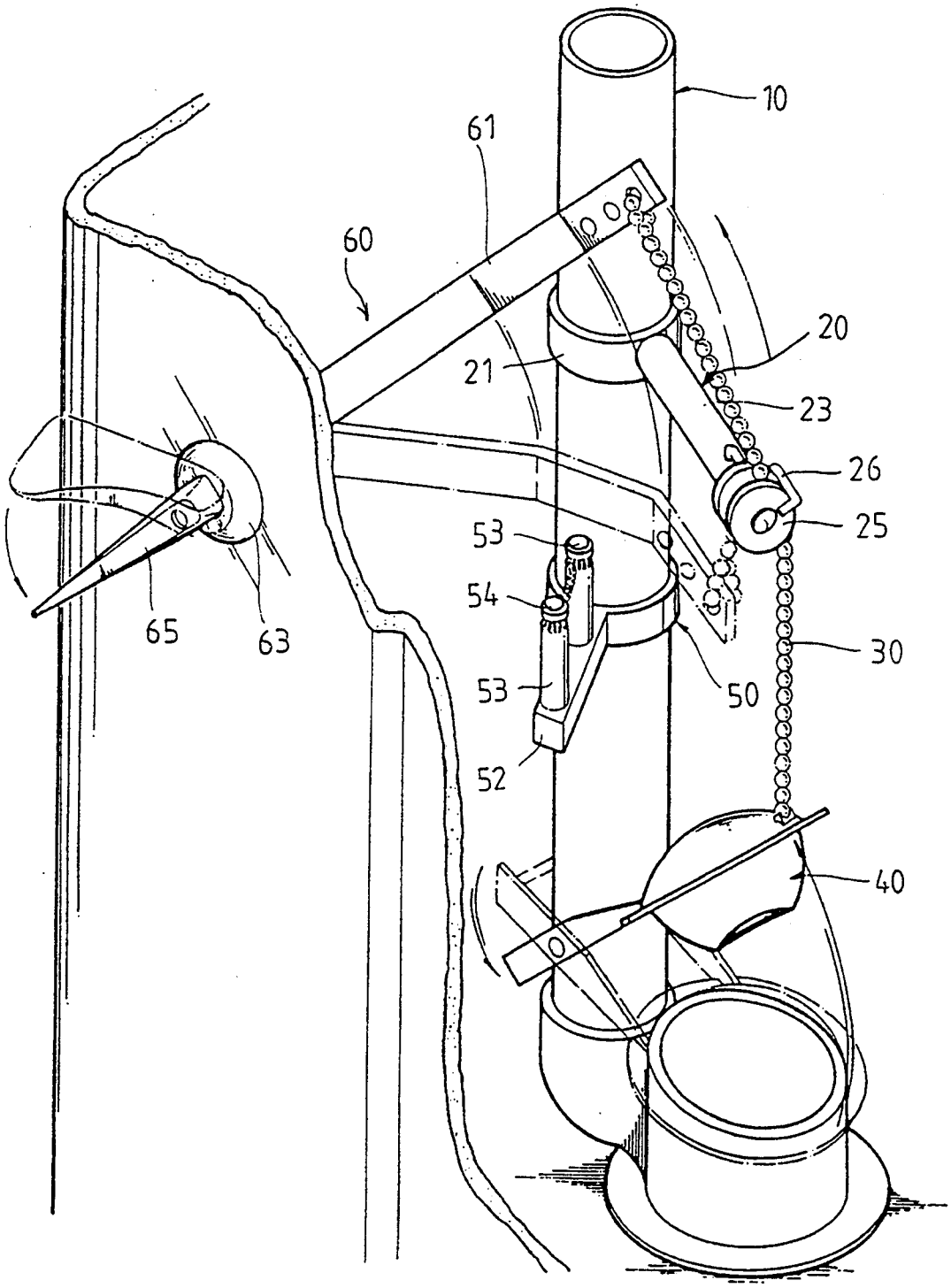
FIG. 3 is a perspective view to show a preferred embodiment of the present invention being fully actuated for discharging flush water out of the water tank.
Figure 4:
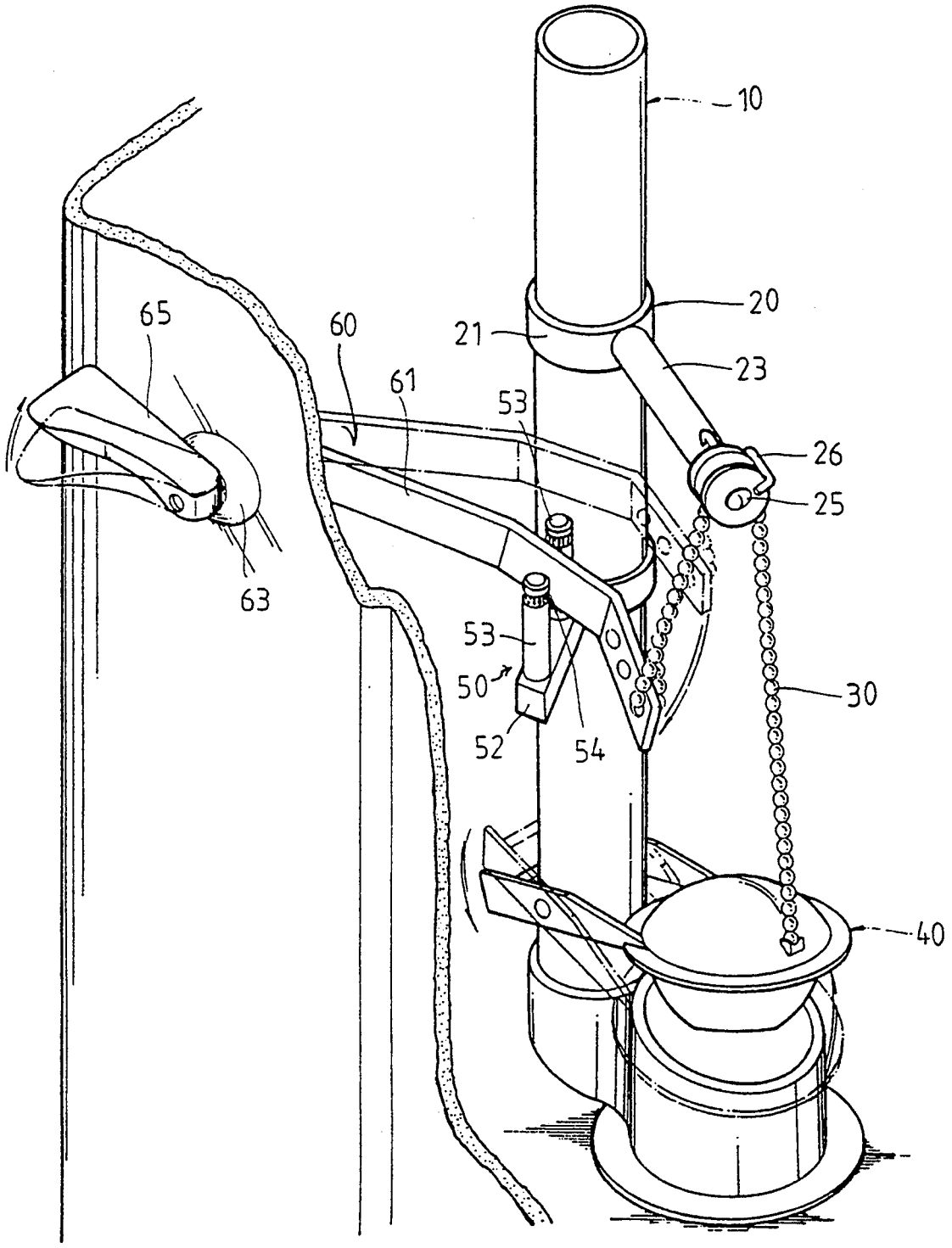
FIG. 4 is a perspective view to show a preferred embodiment of the present invention as a outlet valve being lift up in a limited span on the valve seat.

Referring to FIGS. 2 and 3, the restricting member 50 of this invention is vertically displaceable along the overflow tube 10 to decide a preferred normal discharge amount of the flush water. When the user presses the strip handle 65 counterclockwise as the lift wire 30 is tight to an appropriate tension (as shown in FIG. 3), the actuator arm turns upward to a maximum extent so as to lift the outlet valve 40 fully open allowing to discharge a largest amount of flush water into a tailet pan. Because the outlet valve 40 fills with air, it tends to float and allows a continuously discharging of the flush water at a certain level; but when the water level in the tank runs low, the tank ball drops down on its own weight and thus closes the valve set to replenish the tank again.

When press the strip handle 65 clockwise, the lever means turns downward to a selective span and stops against the recoil spring 54 of the restricting member 50. So that the outlet valve 40 is pulled to lift up in a limited extent therefore allowing a smaller amount of flush water to be discharged therefrom. Holding onto the strip handle 65, the discharge time is controlled until the sufficient flush activity is accomplished. When the handle 65 is released, the outlet valve 40 is automatically dropped down and closes the valve seat for replenishing the water in the tank.

However, the recoil spring 54 disposed to the vertical rods 53 of the restricting member 50 thereinbetween provides a certain elasticity to the actuator arm 61, when it turns to the gup of the two vertical rods 53, it will not touch directly to the surface thereof in order to protect those surfaces from damagement or to prevent the actuator arm 61 from to be trapped therein. Furthermore, the recoil spring 54 provides adequate resilient force to the actuator arm 61 when it turns back to a normal position.

Figure 5:
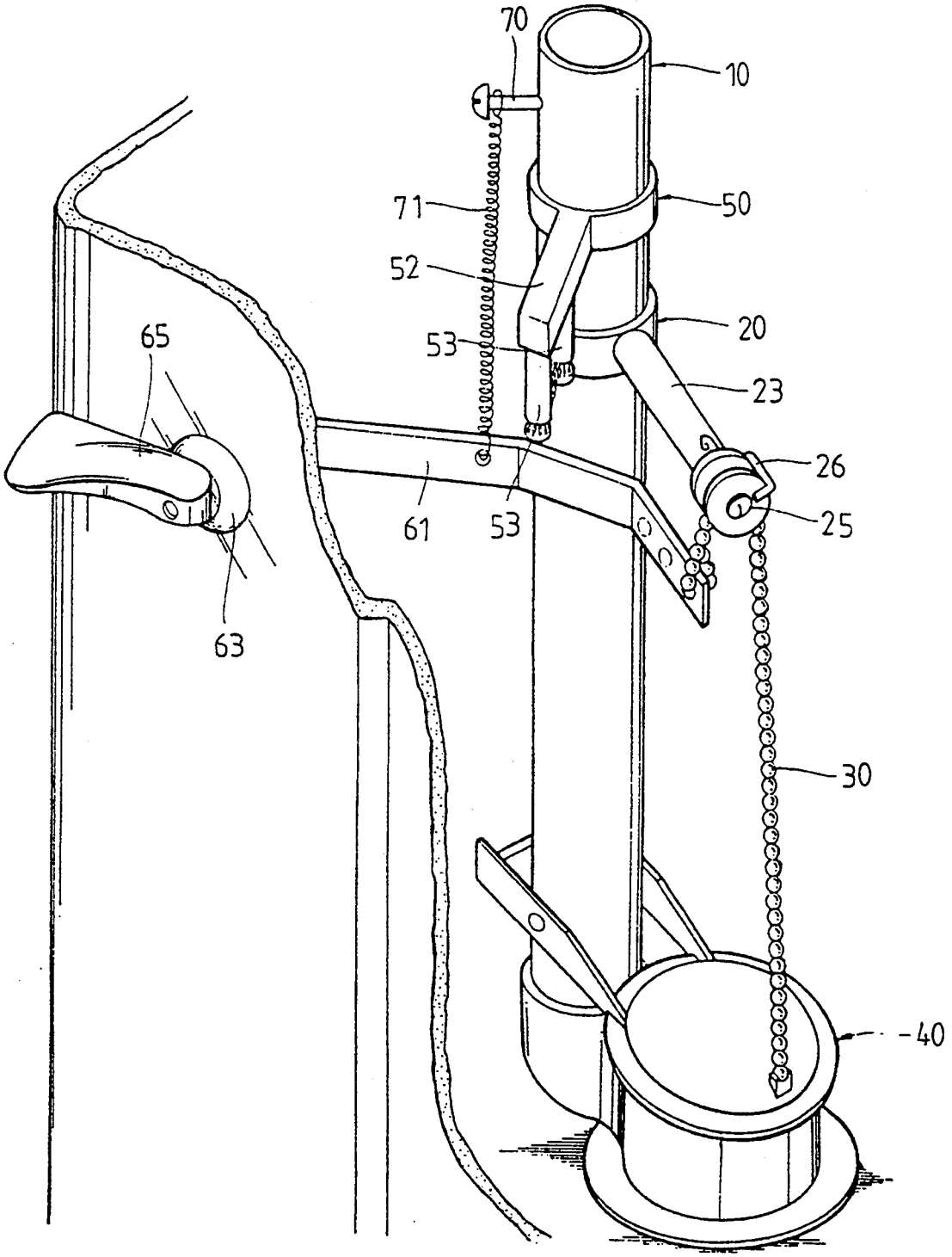
FIG. 5 is a perspective view to show a displacement of the restrictive member on the overflow tube and an addition of a suspension spring to the lever means.
Figure 6:
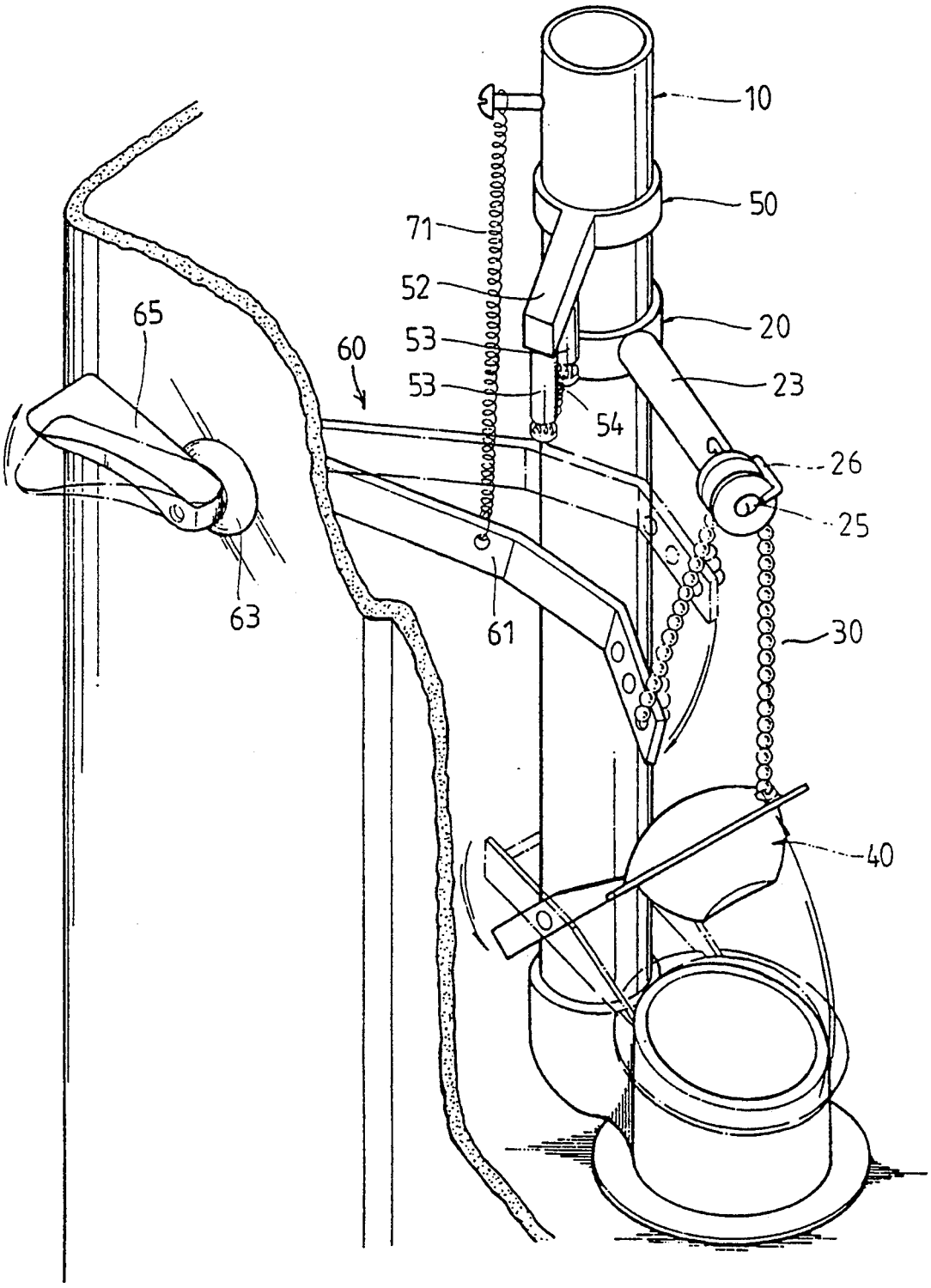
FIG. 6 is a perspective view to show a outlet valve being fully operated upon the valve seat according in FIG. 5.
Figure 7:
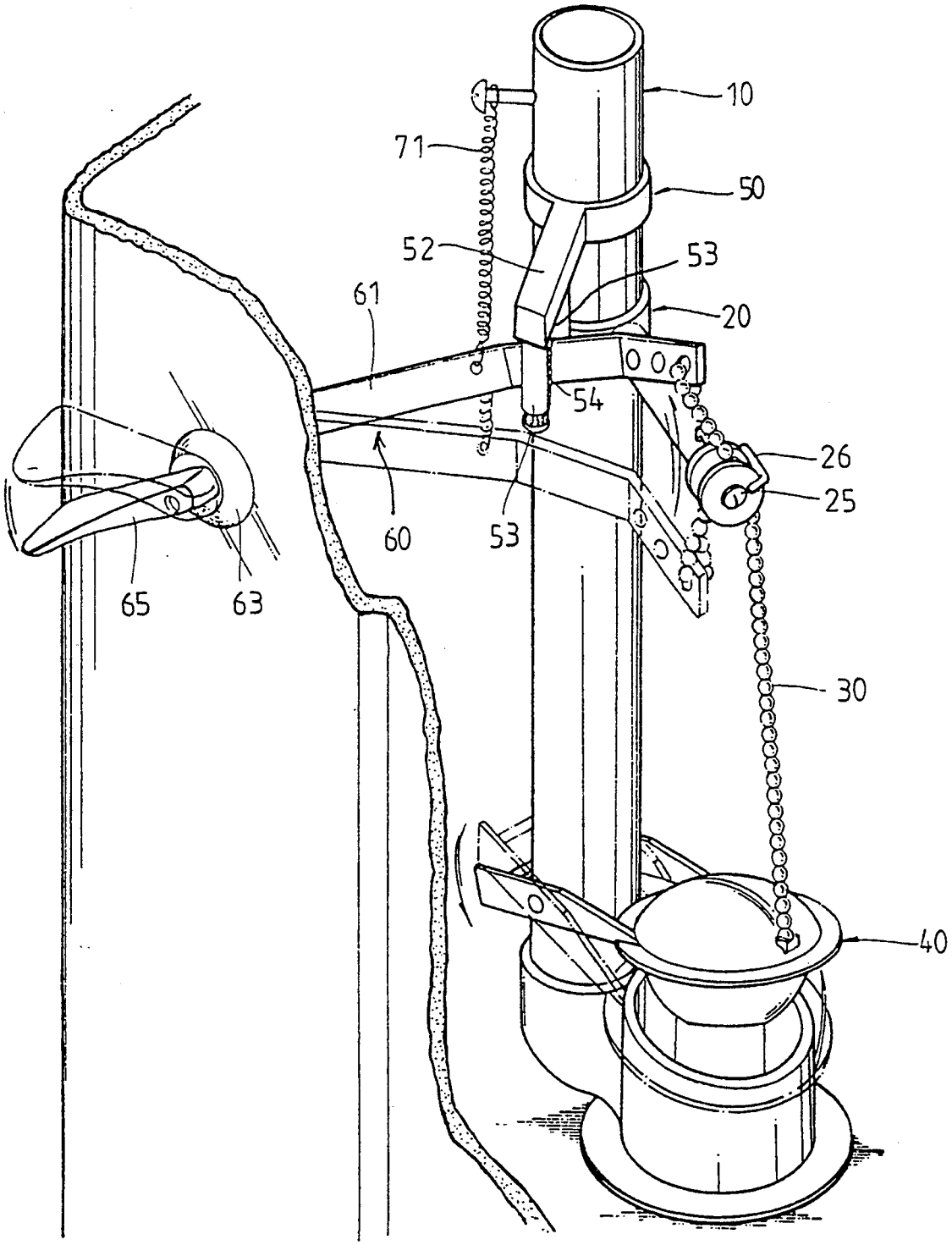
FIG. 7 is perspective view to show a outlet valve being operated in a limited span upon the valve seat according to FIG. 5.

With reference to FIGS. 5, 6 and 7 of the drawings, shows an alterative mode of the present invention. FIG. 5 indicates that the restricting member 50 is turned to upside down and affixed to a position on the overflow tube upper to the support arm 20. A tension spring 71 is added to provide adequate tension force to the lever bar 61, when it turns back to normal position. The spring 71 suspends on one end from a screw 70 on a upper periphery of the overflow tube and the other end from the medial portion of the actuator arm 61.

When press the strip handle 65 clockwise (as shown in FIG. 6), the actuator arm 61 turns downward to a maximum extent so as to affect the outlet valve 40 to be fully opened allowing a largest discharge amount of the flush water therefrom. When the outlet valve trends to drop down that the actuator arm 61 is promptly resiled back to its normal position under a resilient force of the tension spring 71. FIG. 7 indicates a limit discharging of the flush water so as to press counterclockwise the strip handle that the actuator arm 61 turns to upward and is restricted by the restricting member 50 therein to affect the outlet valve 40 opening in a limited extent allowing a small amount of the flush water to be discharged therefrom.

Please, referring again FIG. 10 of a sectional view shows that the flaps 641 of the detent 64 inside the semi-circular goove 631 form a pair of angles $\theta$ in between the end walls of the groove 631 so as to provide a pair of triangular flexible space to the rectangular protrudent stopper 651 that when the protrudent stopper 651 reaches to the end of the groove 631, it will be stopped against and recoiled from the flap 641 for a readily setting back to a normal position.

Based on aforediscussed structure, the flush device for toilet of the present invention provides numerous features and advantages outlined as follows:

a) a restricting member 50 can be displaceable along the outer periphery of a overflow tube 10 that facilitates to vary the discharge amount of the flush water from the water tank therein and the flush time is also controllable under assistance of the restricting member, b) a pulley 25 in accompanied with a catch pawl 26 on the top of the support arm 20 assure a smooth operation of the flush device, and c) a spring detent 64 added to the actuating assembly therein rovides a flexible and smooth operation of the strip bar 65.

The scope of this invention should be determined by the appended claims and their legal equivalents thereof rather than by the exemplar given in above description.

I claim:

1. A flush device for a toilet, comprising a support element, a restricting member and an outlet valve attached in series to an overflow tube of a flush tank, and an actuating assembly connected to said outlet valve via said support element by a flexible connector;

said support element comprising a laterally extending body having one end connected to the overflow tube via a retaining ring and pulley and catch means attached to the other end;

said restricting member comprising an elongate laterally extending body having a retaining ring connected to one end for attachment to the overflow tube, and having a pair of rods spacedly projecting upwardly from an upper surface of said body and spring means connected to the top of each rod and extending between said rods;

said outlet valve comprising a body having a hollow interior and having a circular flange formed on upper portion thereof and having a clevis attached at one end to said circular portion with another end of said clevis being pivotally attached to said overflow tube, a connection means formed at an opposing periphery of said outlet valve;

said actuating assembly further comprising an actuator arm and handle fastened to a front aperture of said water tank with said flexible connector having one end attached to said actuator arm and the other end attached to said connection means with said connector passing over said pulley between said pulley and catch means;

whereby actuation of said handle in one direction will open said outlet valve for a full flush and actuation of said handle in an opposite direction with cause said actuator arm to engage said spring means for opening said outlet valve for a partial flush.

2. A flush device according to claim 1, further having a jacker means for engaging with said actuator arm and said handle said jacker means having a semi-circular groove and notch member on a side for receiving a detent means and a protrudent stopper therein.

3. A flush device according to claim 2, said detent having a flap at each end abutting end walls of said semi-circular groove.

4. A flush device according to claim 1, wherein said restricting member is positionally displaceable and invertible on the outer periphery of said overflow tube.

5. A flush device according to claim 1, further including a spring member for suspending said actuator arm from said overflow tabe.

* * * * *